US008876938B2

(12) United States Patent
Chen et al.

(10) Patent No.: US 8,876,938 B2
(45) Date of Patent: Nov. 4, 2014

(54) PROCESS FOR PRODUCING SPONGE TITANIUM

(75) Inventors: Xuemin Chen, Guangdong (CN); Jun Yang, Guangdong (CN); Zhi Zhou, Guangdong (CN)

(73) Assignee: Shenzhen Sunxing Light Alloys Materials Co., Ltd., Shenzhen, Guangdong (CN)

( * ) Notice: Subject to any disclaimer, the term of this patent is extended or adjusted under 35 U.S.C. 154(b) by 149 days.

(21) Appl. No.: 13/585,717

(22) Filed: Aug. 14, 2012

(65) Prior Publication Data

US 2012/0304825 A1 Dec. 6, 2012

(30) Foreign Application Priority Data

Jan. 18, 2012 (CN) ..... 2012 1 0014934

(51) Int. Cl.
*C22B 34/12* (2006.01)

(52) U.S. Cl.
CPC ..... *C22B 34/1277* (2013.01); *C22B 34/1272* (2013.01)
USPC ..... 75/616; 75/618; 75/619

(58) Field of Classification Search
CPC ..... C22B 34/1277; C22B 34/1272
USPC ..... 75/616, 618–619
See application file for complete search history.

(56) References Cited

U.S. PATENT DOCUMENTS

| | | | | | |
|---|---|---|---|---|---|
| 2,785,971 | A | * | 3/1957 | Kamlet | 75/419 |
| 2,823,991 | A | * | 2/1958 | Kamlet | 75/615 |
| 4,390,365 | A | * | 6/1983 | Hard et al. | 75/419 |
| 4,468,248 | A | * | 8/1984 | Megy | 75/615 |

* cited by examiner

*Primary Examiner* — George Wyszomierski
*Assistant Examiner* — Tima M McGuthry Banks
(74) *Attorney, Agent, or Firm* — Jackson IPG PLLC

(57) ABSTRACT

The present invention provides a process for producing sponge titanium, which includes the following steps: Step A: placing aluminum into a resistance furnace, vacuum pumping, introducing inert gas, heating to molten aluminum; Step B: opening a reactor cover, adding a proper amount of potassium fluotitanate to a reactor, leakage detecting after closing the reactor cover, slowly raising the temperature to 150° C., vacuum pumping, and continuously heating to 250° C.; Step C: introducing inert gas into the reactor, continuously raising the temperature to 750° C., stirring uniformly; Step D: opening a valve to adjust the stirring speed, adding molten aluminum drops, and controlling the reaction temperature to 750° C. to 850° C.; Step E: opening the reactor cover, removing a stirring device, eliminating the upper layer of $KAlF_4$ to obtain sponge titanium. The present invention has the beneficial effects of short process flow, low cost, environmental protection and harmlessness.

10 Claims, No Drawings

PROCESS FOR PRODUCING SPONGE TITANIUM

TECHNICAL FIELD OF THE INVENTION

The present invention relates to a process for producing sponge titanium, and in particular to a process for producing sponge titanium, which is low in cost, high efficient and can continuously run.

BACKGROUND OF THE INVENTION

The production process of sponge titanium at home and abroad mainly adopts metallothermic reduction process, and in particular refers to preparing metal M from metal reducing agent (R) and metal oxide or chloride (MX). Titanium metallurgy method in which industrial production has been achieved is magnesiothermic reduction process (Kroll process) and sodiothermic reduction process (Hunter process). Since the Hunter process leads to higher production cost than the Kroll process does, the Kroll process is widely used in industry currently. The main processes of the Kroll process are that magnesium ingot is placed into a reactor, heated and molten after being subjected to oxide films and impurities removal, then titanium tetrachloride ($TiCl_4$) is introduced into the reactor, titanium particles generated by the reaction are deposited, and generated liquid magnesium chloride is discharged promptly through a slag hole. The reaction temperature is usually kept at 800° C. to 900° C., the reaction time is between several hours and several days. Residual metallic magnesium and magnesium chloride in end product can be removed by washing with hydrochloric acid, can also be removed by vacuum distillation at 900 degrees Celsius, and keep the purity of titanium high. The Kroll process has the disadvantages of high cost, long production cycle, and polluted environment, limiting further application and popularization. At present, the process has not changed fundamentally, and still belongs to intermittent production, which fails to realize continuous production.

SUMMARY OF THE INVENTION

In order to solve the shortcomings of high cost, severe pollution and long production cycle in prior art, the present invention provides a process for producing sponge titanium technically:

Scheme 1: a method for preparing titanium from potassium fluotitanate with aluminothermic reduction process:

Equation Involved: $3K_2TiF_6+4Al=3Ti+6KF+4AlF_3$

Scheme 2: a method for preparing sponge titanium from potassium fluotitanate with magnesiothermic reduction process:

Equation Involved: $K_2TiF_6+2Mg=Ti+2MgF_2+2KF$

Scheme 3: a method for preparing sponge titanium from potassium fluotitanate with aluminum magnesium thermal reduction process:

Equations Involved:

$$3K_2TiF_6+4Al=3Ti+6KF+4AlF_3$$

$$K_2TiF_6+2Mg=Ti+2MgF_2+2KF$$

Since the potassium fluotitanate, aluminum and magnesium are solids in the raw material, the present invention designs a piece of reaction equipment for producing sponge titanium, which includes: a reactor and a reactor cover with a stirring device, wherein a sealing ring is arranged between the reactor cover and the reactor, one side of the reactor cover is provided with a lifting device for controlling the lifting of the reactor cover, a sealed resistance furnace is arranged above the reactor cover, a valve is arranged below the resistance furnace, and a vacuum-pumping pipe and an inflation pipe are arranged above the reactor cover.

Correspondingly, the present invention provides a process for producing sponge titanium, which includes the following steps:

Step A: placing aluminum into the sealed resistance furnace, vacuum pumping, introducing inert gas, heating to molten aluminum;

Step B: opening the reactor cover, adding a proper amount of potassium fluotitanate to a reactor, leakage detecting after closing the reactor cover, slowly raising the temperature to 150° C., vacuum pumping, and continuously heating to 250° C.;

Step C: introducing inert gas into the reactor, continuously raising the temperature to 750° C., stirring uniformly;

Step D: opening a valve to adjust the stirring speed, adding molten aluminum drops, and controlling the reaction temperature to 750° C. to 850° C.;

Step E: opening the reactor cover, removing the stirring device, eliminating the upper layer of $KAlF_4$ to obtain sponge titanium.

The present invention also provides a second process for producing sponge titanium, which includes the following steps:

Step A': placing magnesium into the sealed resistance furnace, vacuum pumping, introducing inert gas, heating to molten magnesium;

Step B': opening the reactor cover, adding a proper amount of potassium fluotitanate to a reactor, leakage detecting after closing the reactor cover, slowly raising the temperature to 150° C., vacuum pumping, and continuously heating to 250° C.;

Step C': introducing inert gas into the reactor, continuously raising the temperature to 750° C.;

Step D': opening a valve to adjust the stirring speed, adding molten magnesium drops, and controlling the reaction temperature to 750° C. to 850° C.;

Step E': opening the reactor cover, removing the stirring device, eliminating the upper layers of KF and $KAlF_4$ to obtain sponge titanium.

Preferably, the mass ratio of aluminum to magnesium is 1:1 to 1:10.

The present invention also provides a third process for producing sponge titanium, which includes the following steps:

Step A": placing aluminum and magnesium into the sealed resistance furnace, vacuum pumping, introducing inert gas, heating to generate a mixed liquid;

Step B": opening the reactor cover, adding a proper amount of potassium fluotitanate to a reactor, leakage detecting after closing the reactor cover, slowly raising the temperature to 150° C., vacuum pumping, and continuously heating to 250° C.;

Step C": introducing inert gas into the reactor, continuously raising the temperature to 750° C.;

Step D": opening a valve to adjust the stirring speed, adding the mixed liquid, and controlling the reaction temperature to 750° C. to 850° C.;

Step E": opening the reactor cover, removing the stirring device, eliminating the upper layers of KF and $KAlF_4$, KF and $MgF_2$ to obtain sponge titanium.

Preferably, the mass ratio of aluminum to magnesium is 18:1 to 1:1.

The present invention has the beneficial effects that, by adopting the above technical schemes, the present invention has short process flow, low cost, environmental protection and harmlessness as compared to the traditional process. The reduction rate and yield of sponge titanium are comparable with the prior art, and the resulting sponge titanium can be directly used for process production, thereby further saving resources and costs.

DETAILED DESCRIPTION OF THE PREFERRED EMBODIMENTS

The preferred embodiments of the present invention are further described in detail below:

Scheme 1: a method for preparing titanium from potassium fluotitanate with aluminothermic reduction process Equation Involved: $3K_2TiF_6+4Al=3Ti+6KF+4AlF_3$ Embodiment 1:

The method includes the following steps:

1. placing 36 g of aluminum into the resistance furnace, vacuum pumping, introducing argon, heating to molten aluminum;

2. opening the reactor cover, adding 240 g of potassium fluotitanate to the reactor, leakage detecting after closing the reactor cover, slowly raising the temperature to 150° C., vacuum pumping, and continuously heating to 250° C.;

3. introducing inert gas into the reactor, continuously raising the temperature to 750° C., stirring uniformly;

4. opening a valve to adjust the stirring speed, adding molten aluminum drops, and controlling the reaction temperature to 750° C. to 850° C.;

5. opening the reactor cover, removing the stirring device, eliminating the upper layer of $KAlF_4$ to obtain 50.22 g of sponge titanium in which the content of titanium is 90.8% and the reduction rate is 95%.

Embodiment 2:

The method includes the following steps:

1. placing 40 g of aluminum into the resistance furnace, vacuum pumping, introducing inert gas, heating to molten aluminum;

2. opening the reactor cover, adding 240 g of potassium fluotitanate to the reactor, leakage detecting after closing the reactor cover, slowly raising the temperature to 150° C., vacuum pumping, and then heating to 250° C.;

3. introducing inert gas into the reactor, continuously raising the temperature to 750° C., stirring uniformly;

4. opening a valve to adjust the stirring speed, adding molten aluminum drops, and controlling the reaction temperature to 750° C. to 850° C.;

5. opening the reactor cover, removing the stirring device, eliminating the upper layer of $KAlF_4$ to obtain 48.39 g of sponge titanium in which the content of titanium is 97% and the reduction rate is 97.8%.

Embodiment 3:

The method includes the following steps:

1. placing 44 g of aluminum into the resistance furnace, vacuum pumping, introducing inert gas, heating to molten aluminum;

2. opening the reactor cover, adding 240 g of potassium fluotitanate to the reactor, leakage detecting after closing the reactor cover, slowly raising the temperature to 150° C., vacuum pumping, and then heating to 250° C.;

3. introducing inert gas into the reactor, continuously raising the temperature to 750° C., stirring uniformly;

4. opening a valve to adjust the stirring speed, adding molten aluminum drops, and controlling the reaction temperature to 750° C. to 850° C.;

5. opening the reactor cover, removing the stirring device, eliminating the upper layer of $KAlF_4$ to obtain 48.29 g of sponge titanium in which the content of titanium is 98.6% and the reduction rate is 99.2%.

TABLE 1

Reaction test data

| Embodiment | Amount of added raw material, g | | Theoretical Ti quantity, | Obtained sponge titanium product, | Ti content of product, | Reduction rate, |
|---|---|---|---|---|---|---|
| | $K_2TiF_6$ | Al | g | g | % | % |
| 1 | 240 | 36 | 48 | 50.22 | 90.8 | 95 |
| 2 | 240 | 40 | 48 | 48.39 | 97 | 97.8 |
| 3 | 240 | 44 | 48 | 48.29 | 98.6 | 99.2 |

Reduction rate (%) = (obtained sponge titanium product *Ti content of product)/theoretical Ti quantity Scheme 2: a method for preparing sponge titanium from potassium fluotitanate with magnesiothermic reduction process Equation Involved: $K_2TiF_6+2Mg=Ti+2MgF_2+2KF$ Embodiment 4:

The method includes the following steps:

1. placing aluminum into the resistance furnace, vacuum pumping, introducing inert gas, heating to molten aluminum;

2. opening the reactor cover, adding a calculated amount of potassium fluotitanate to the reactor, leakage detecting after closing the reactor cover, slowly raising the temperature to 150° C., vacuum pumping, and then heating to 250° C.;

3. introducing inert gas into the reactor, continuously raising the temperature to 750° C.;

4. opening a valve to adjust the stirring speed, adding molten aluminum drops, and controlling the reaction temperature to 750° C. to 850° C.;

5. opening the reactor cover, removing the stirring device, eliminating the upper layers of KF and $MgF_2$ to obtain 47.56 g of sponge titanium in which the content of titanium is 99.2% and the reduction rate is 98.3%.

TABLE 2

Reaction test data

| Embodiment | Amount of added raw material, g | | Theoretical Ti quantity, | Obtained sponge titanium product, | Ti content of product, | Reduction rate, |
|---|---|---|---|---|---|---|
| | $K_2TiF_6$ | Mg | g | g | % | % |
| 4 | 240 | 48 | 48 | 47.56 | 99.2 | 98.3 |

Scheme 3: a method for preparing sponge titanium from potassium fluotitanate with aluminum magnesium thermal reduction process Chemical Equations Involved:

$$3K_2TiF_6+4Al=3Ti+6KF+4AlF_3$$

$$K_2TiF_6+2Mg=Ti+2MgF_2+2KF$$

Embodiment 5:

The method includes the following steps:

1. placing 36 g of aluminum and 36 g of magnesium into the resistance furnace, vacuum pumping, introducing argon, heating to generate a mixed liquid;

2. opening the reactor cover, adding 240 g of potassium fluotitanate to the reactor, leakage detecting after closing the reactor cover, slowly raising the temperature to 150° C., vacuum pumping, and then heating to 250° C.;

3. introducing inert gas into the reactor, continuously raising the temperature to 750° C.;

4. opening a valve to adjust the speed, adding mixed liquid drops, and controlling the reaction temperature to 750° C. to 850° C.;

5. opening the reactor cover, removing the stirring device, eliminating the upper layers of $KAlF_4$, KF and $MgF_2$ to obtain 45.12 g of sponge titanium in which the content of titanium is 96.5% and the reduction rate is 90.7%.

Embodiment 6:

The method includes the following steps:

1. placing 36 g of aluminum and 18 g of magnesium into the resistance furnace, vacuum pumping, introducing inert gas, heating to generate a mixed liquid;

2. opening the reactor cover, adding 240 g of potassium fluotitanate to the reactor, leakage detecting after closing the reactor cover, slowly raising the temperature to 150° C., vacuum pumping, and then heating to 250° C.;

3. introducing inert gas into the reactor, continuously raising the temperature to 750° C.;

4. opening a valve to adjust the speed, adding mixed liquid drops, and controlling the reaction temperature to 750° C. to 850° C.;

5. opening the reactor cover, removing the stirring device, eliminating the upper layers of $KAlF_4$, KF and $MgF_2$ to obtain 45.45 g of sponge titanium in which the content of titanium is 98% and the reduction rate is 92.8%.

Embodiment 7:

The method includes the following steps:

1. placing 36 g of aluminum and 9 g of magnesium into the resistance furnace, vacuum pumping, introducing inert gas, heating to generate a mixed liquid;

2. opening the reactor cover, adding 240 g of potassium fluotitanate to the reactor, leakage detecting after closing the reactor cover, slowly raising the temperature to 150° C., vacuum pumping, and then heating to 250° C.;

3. introducing inert gas into the reactor, continuously raising the temperature to 750° C.;

4. opening a valve to adjust the speed, adding mixed liquid drops, and controlling the reaction temperature to 750° C. to 850° C.;

5. opening the reactor cover, removing the stirring device, eliminating the upper layers of $KAlF_4$, KF and $MgF_2$ to obtain 47.9 g of sponge titanium in which the content of titanium is 99.5% and the reduction rate is 99.3%.

Embodiment 8:

The method includes the following steps:

1. placing 36 g of aluminum and 2 g of magnesium into the resistance furnace, vacuum pumping, introducing inert gas, heating to generate a mixed liquid;

2. opening the reactor cover, adding 240 g of potassium fluotitanate to the reactor, leakage detecting after closing the reactor cover, slowly raising the temperature to 150° C., vacuum pumping, and then heating to 250° C.;

3. introducing inert gas into the reactor, continuously raising the temperature to 750° C.;

4. opening a valve to adjust the stirring speed, adding mixed liquid drops, and controlling the reaction temperature to 750° C. to 850° C.;

5. opening the reactor cover, removing the stirring device, eliminating the upper layers of $KAlF_4$, KF and $MgF_2$ to obtain 48.29 g of sponge titanium in which the content of titanium is 98.9% and the reduction rate is 99.5%.

TABLE 3

Reaction test data

| Embodiment | Amount of added raw material, g | | | Theoretical Ti quantity, | Obtained sponge titanium product, | Ti content of product, | Reduction rate, |
|---|---|---|---|---|---|---|---|
| | $K_2TiF_6$ | Al | Mg | g | g | % | % |
| 5 | 240 | 36 | 36 | 48 | 45.12 | 96.5 | 90.7 |
| 6 | 240 | 36 | 18 | 48 | 45.45 | 98 | 92.8 |
| 7 | 240 | 36 | 9 | 48 | 47.9 | 99.5 | 99.3 |
| 8 | 240 | 36 | 2 | 48 | 48.29 | 98.9 | 99.5 |

The above is the further detailed description made to the invention in conjunction with specific preferred embodiments, but it should not be considered that the specific embodiments of the invention are only limited to the these descriptions. For one of ordinary skill in the art to which the invention belongs, many simple deductions and replacements can be made without departing from the inventive concept. Such deductions and replacements should fall within the scope of protection of the invention.

What is claimed is:

1. A process for producing sponge titanium, wherein equipment for producing sponge titanium comprises: a reactor and a reactor cover with a stirring device, wherein a sealing ring is arranged between the reactor cover and the reactor, one side of the reactor cover is provided with a lifting device for controlling the lifting of the reactor cover, a sealed resistance furnace is arranged above the reactor cover, a valve is arranged below the resistance furnace, and a vacuum-pumping pipe and an inflation pipe are arranged above the reactor cover;

a method comprises the following steps:

step A: placing aluminum into the sealed resistance furnace, vacuum pumping, introducing inert gas, heating to molten aluminum;

step B: opening the reactor cover, adding potassium fluotitanate to a reactor, leakage detecting after closing the reactor cover, raising a temperature to 150° C., vacuum pumping, and continuously heating to 250° C.;

step C: introducing inert gas into the reactor, continuously raising the temperature to 750 degrees Celsius, stirring uniformly;

step D: opening a valve to adjust a stirring speed, adding molten aluminum drops, and controlling a reaction temperature to 750° C. to 850° C.; and step E: opening the reactor cover, removing the stirring device, eliminating an upper layer of $KAlF_4$ to obtain sponge titanium.

2. The process according to claim 1, wherein a time for adding molten aluminum drops in step D is 4 hours.

3. The process according to claim 1, wherein the stirring speed is 60 r/min.

4. A process for producing sponge titanium, wherein equipment for producing sponge titanium comprises: a reactor and a reactor cover with a stirring device, wherein a sealing ring is arranged between the reactor cover and the reactor, one side of the reactor cover is provided with a lifting device for controlling the lifting of the reactor cover, a sealed resistance furnace is arranged above the reactor cover, a valve is arranged below the resistance furnace, and a vacuum-pumping pipe and an inflation pipe are arranged above the reactor cover;

a method comprises the following steps:

step A': placing magnesium into the sealed resistance furnace, vacuum pumping, introducing inert gas, heating to molten magnesium;

step B': opening the reactor cover, adding potassium fluotitanate to a reactor, leakage detecting after closing the reactor cover, raising a temperature to 150° C., vacuum pumping, and continuously heating to 250° C.;

step C': introducing inert gas into the reactor, continuously raising the temperature to 750° C.;

step D': opening a valve to adjust a stirring speed, adding molten magnesium drops, and controlling a reaction temperature to 750° C. to 850° C.; and step E': opening the reactor cover, removing the stirring device, eliminating upper layers of KF and $KAlF_4$ to obtain sponge titanium.

5. The process according to claim 4, wherein a time for adding molten magnesium drops in step D is 4 hours.

6. The process according to claim 4, wherein the stirring speed is 60 r/min.

7. A process for producing sponge titanium, wherein equipment for producing sponge titanium comprises: a reactor and a reactor cover with a stirring device, wherein a sealing ring is arranged between the reactor cover and the reactor, one side of the reactor cover is provided with a lifting device for controlling the lifting of the reactor cover, a sealed resistance furnace is arranged above the reactor cover, a valve is arranged below the resistance furnace, and a vacuum-pumping pipe and an inflation pipe are arranged above the reactor cover;

a method comprises the following steps:

step A": placing aluminum and magnesium into the sealed resistance furnace, vacuum pumping, introducing inert gas, heating to generate a mixed liquid;

step B": opening the reactor cover, adding potassium fluotitanate to a reactor, leakage detecting after closing the reactor cover, raising a temperature to 150° C., vacuum pumping, and continuously heating to 250° C.;

step C": introducing inert gas into the reactor, continuously raising the temperature to 750° C.;

step D": opening a valve to adjust a stirring speed, adding the mixed liquid, and controlling a reaction temperature to 750° C. to 850° C.; and step E": opening the reactor cover, removing the stirring device, eliminating upper layers of KF and $KAlF_4$, KF and $MgF_2$ to obtain sponge titanium.

8. The process according to claim 7, wherein a mass ratio of aluminum to magnesium is 18:1 to 1:1.

9. The process according to claim 7, wherein a time for adding mixed liquid in step D is 4 hours.

10. The process according to claim 7, wherein the stirring speed is 60 r/min.

* * * * *